US006843437B2

(12) United States Patent
Pohn et al.

(10) Patent No.: US 6,843,437 B2
(45) Date of Patent: Jan. 18, 2005

(54) DISINTEGRATOR ROLL FOR USE IN A TEXTILE MACHINE

(75) Inventors: Romeo Pohn, Geisenfeld/Rottenegg (DE); Josef Schermer, Bergheim-Unterstall (DE); Werner Schmolke, Uehlfeld (DE)

(73) Assignee: Rieter Ingolstadt Spinnereimaschinenbau AG, Ingolstadt (DE)

( * ) Notice: Subject to any disclaimer, the term of this patent is extended or adjusted under 35 U.S.C. 154(b) by 33 days.

(21) Appl. No.: 10/176,361

(22) Filed: Jun. 20, 2002

(65) Prior Publication Data

US 2003/0019966 A1 Jan. 30, 2003

(30) Foreign Application Priority Data

Jul. 6, 2001 (DE) ..... 101 32 867

(51) Int. Cl.[7] ..... B02C 19/00
(52) U.S. Cl. ..... 241/294; 241/295
(58) Field of Search ..... 19/97, 112; 241/294, 241/295

(56) References Cited

U.S. PATENT DOCUMENTS 4,296,527 A * 10/1981 Eadie
4,300,265 A 11/1981 Heinen
4,574,583 A 3/1986 Stahlecker et al.
4,679,390 A 7/1987 Stewart
4,854,119 A * 8/1989 Stahlecker et al.
6,006,511 A * 12/1999 Hofmann et al.

FOREIGN PATENT DOCUMENTS

DE 3336327 A1 * 4/1985
DE 4142067 A1 * 6/1993
DE 19732541 * 2/1999
DE 19934893 * 1/2001
GB 2084620 * 4/1982

OTHER PUBLICATIONS

German Patent Office Search Report, Oct. 23, 2001.*
European Patent Office Search Report, Jul. 18, 2003.

* cited by examiner

*Primary Examiner*—Mark Rosenbaum
(74) *Attorney, Agent, or Firm*—Dority & Manning, P.A.

(57) ABSTRACT

A disintegrator roll for use in a textile spinning machine, such as an open-end spinning machine, includes a roll body releasably mounted onto a drive shaft. A fittings carrier with associated fittings is releasably mounted on the roll body. A releasable connection apparatus is operably disposed between either the fittings carrier and the roll body or the roll body and the drive shaft. The connection apparatus is actuated by an axial force applied generally parallel to the drive shaft.

16 Claims, 4 Drawing Sheets

DISINTEGRATOR ROLL FOR USE IN A TEXTILE MACHINE

BACKGROUND

The present invention concerns a disintegrator roll of the type having a fittings carrier on a roll body rotated by a drive shaft.

In a known design of a disintegrator roll, a roll body is placed on a rotatable drive shaft, to which a fittings carrier is bound with the aid of a multiplicity of screws. These screws extend through corresponding borings in the roll body and on into blind borings made in the fittings carrier (open-end rotor spinning machine of the firm, Rieter Ingolstadt Spinnereimaschinenbau, AG). When a change of the fittings carrier becomes necessary, then the disintegrator along with its drive shaft must be disassembled. In carrying this out, the drive shaft of the said disintegrator must be relieved of the drive belts assigned to it, which operation, considering the close working quarters common to a spinning station, is very troublesome. The person trusted to this task must be in possession of a certain amount of ingenuity. So that the duration of the standstill of this kind of a disintegrator roll is held to a minimum, complete disintegrator rolls are held in immediate shop inventory. The replacement of the original fittings carrier is then carried out external to the machine and independent of the time of exchange to the new disintegrator rolls at the spinning station in question.

SUMMARY

A purpose of the invention is accordingly, to improve the described disintegrator roll in such a manner, that a necessitated change of the fittings carrier can be executed simply and quickly without the dismantling of the complete disintegrator roll. Additional objects and advantages of the invention will be set forth in part in the following description, or may be obvious from the description, or may be learned through practice of the invention.

Because of the invented fastening of the roll body on the drive shaft, with the aid of a releasable connection in accord with an embodiment of the invention, this connection can be restored in a quick and timesaving manner without dismantling and reassembling the drive shaft.

When this is done, the disintegrator roll can be constructed from multiple parts. Advantageously, the disintegrator roll is either a two-part roll, namely, fittings carrier and roll body, or of three-part design including these parts plus a cover element. In the case of the three-part arrangement, the cover element is to be understood as being related to the fittings carrier, so that the releasable connection can also encompass this cover element and the roll body.

In a particularly advantageous embodiment, the releasable connection can be made by creating either a push or pull in the axial direction. If this is done, it is not necessary, that the drive shaft or the roll body be secured against rotation at the time of withdrawal or the setting of the disintegrator roll on the shaft. For the freeing or replacement of the fittings carrier, no rotary motion or torque is necessary. On this account, a blocking means to prevent rotation of the drive shaft can be dispensed with.

In a favorable manner, the releasable connection can be achieved by a clip or a latch type binding, which requires a lesser degree of mechanical expense of time and cost, and is therefore an economical step. In accord with a preferred development of the disintegrator roll, provision can be made that the connection device can be activated without auxiliary tools which are not generally available at a spinning station.

Alternatively, or additionally, provided to the releasable connector between the roll body and the drive shaft, is a clip or latch type connector between the fittings carrier and the roll body for which the above described advantages are also valid.

For the clip type connector, a design in keeping with the invention is to be found wherein the connection apparatus exhibits a studlike element and a stud receptor acting therewith, which receptor is oriented in parallel to the axis of the disintegrator roll, and has an open end, into which the cross section of the studlike element is designed to fit, and on its entry end a narrowed passage exists, wherein the stud receptor and or the studlike element are constructed elastically in their directions transverse to their longitudinal axes. Where a latch design is considered, a connection device is particularly advantageous wherein a latch hook and a latch shoulder bordering a recess are provided, as well as a release apparatus which can be activated by the movement of the latch hook in the longitudinal direction of the recess. In this latching design, the connection device in one embodiment possesses a releasing mechanism having a lifting edge opposite the latch shoulder and bordering the recess, by means of which the latch hook running onto the lifting edge can be raised out of the said recess and can be diverted into a movement path which departs from the recess, along which the latch hook can be guided out of the longitudinal area of the parts which define the recess. This design has a lifting element, by which a latch hook is caused to run free by displacement and in this manner, be released from the latched position. Subsequently, the latch hook, without again setting up the latch lock, must again pass through a recess bordered by a latching shoulder, which, advantageously, with the aid of the invented apparatus can be easily done.

Because of the intense centrifugal force which comes into being during machine operation, in order to prevent the latch from flying out of its holding position against the detent latch shoulder which borders the recess, it is possible that, as shown in an additional development of the invention, the latch shoulder can be made with a backcut, into which the latch element can engage when cut to a complementary shape.

By means of the design of the invention connector in accord with a particular embodiment of the invention, the connection between the roll body and the fittings carrier can be lifted, without any relative movement of those components. In order to exclude that the movable part of the connector can unduly leave the fittings carrier, this part of the connector can be secured by a retention detent and an additional latch device.

To ease the duty of the operator in the release of the described apparatus, in an advantageous manner, the invented apparatus is equipped with a manual ejection plate. This ejection device may be placed coaxially to the fittings carrier. Advantageously, provision may be made for an activation element to be axially displaced inside the designed hollow drive shaft of the disintegrator roll. This activation element may be employed as an ejection element.

In order that the roll body and the drive shaft of the disintegrator may be quickly and securely bound together with the aid of clips or latch connection devices on the one hand, and upon need, can likewise be quickly released, according to an advantageous improvement of the invented device, a connector has been provided in accord with an embodiment wherein the roll body and the drive shaft are bound together in the axial direction with the aid of a clip or latch type connection apparatus, and in that between the roll body and the drive shaft a clearance is provided, and in that the roll body and the drive shaft are force fit connected with one another in the direction of rotation. For the release of the connector, this can be done with an axially displaceable activation element placed in the hollow designed drive shaft.

In accord with an advantageous improvement, the activation element can have a lifting element, with the aid of which the clipped or latched type connector can be caused to move in a radial direction for establishment of or release of the connecting function.

From the standpoint of available space and because of easing manipulation, it is of advantage if the activation element within the drive shaft remains permanently in the said hollow drive shaft.

It is advantageous, if this is done, to subject the activation element to an element with a spring like force in such a manner that the activation element is prevented from releasing the connection between the roll body and the drive shaft.

With the aid of the invented apparatus, it becomes possible to carry out a change of the fittings carrier of the disintegrator without the necessity of removing the roll body or the drive shaft from their respective operating positions. The pivoting and twisting motions in a close working space, which were formerly carried out in exchange of the disintegrator roll requiring the removal and resetting of the drive shaft upon which it is carried, are now dispensed with. A change of the fittings can now be accomplished by a simple removal of the fittings carrier, whereby only a clip or latch type connection need be released, which can be done in a time saving and simple manner. Beyond this, where the shop inventory is concerned, a considerable saving in space is acquired, since, instead of holding as emergency supply a complete disintegrator roll, including its drive shaft, now only the fittings carrier must be stored as a replacement item. Thus, it is now possible to release a connection between the roll body and the drive shaft of the disintegrator, and to reestablish the same, without difficulties, even though these connection elements are to be found in positions that are very difficult to access.

Embodiments of the invention are presented in the following with the aid of drawings.

DETAILED DESCRIPTION

Reference will now be made in detail to embodiments of the invention, examples of which are illustrated in the figures. Each embodiment is provided by way of explanation of the invention and not meant as a limitation of the invention. It is intended that the invention include modifications and variations to the embodiments described herein.

Figure 1:
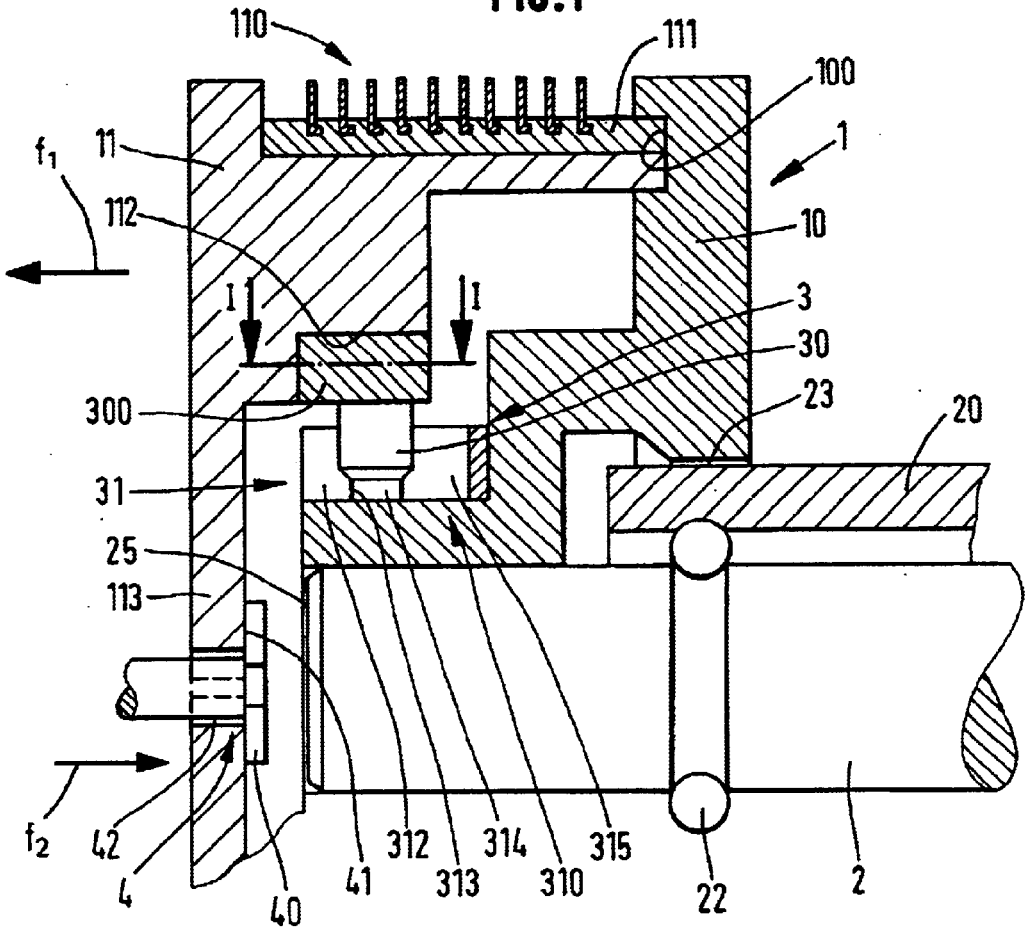
FIG. 1 in longitudinal section, a disintegrator roll constructed in accord with the invention, with a clip type connector between the roll body of said disintegrator roll and its fittings carrier.

As shown in FIG. 1, each spinning unit of an open-end spinning machine possesses a disintegrator with a disintegrator roll (1) enclosed in a housing (not shown), which is assembled from several disintegrator roll components, namely a roll body 10 and a fittings carrier 11 which bears the fittings 110. The roll body 10, by force fit, is placed on a drive shaft 2. The drive shaft 2 receives its own rotational drive in the customary way by means of a circumferential shaft sheave 21 (see FIG. 8) which is disposed on the end of the drive shaft, remote from the roll body 10. This sheave 21 accommodates a tangential or single drive belt (not shown). The drive shaft 2 is carried in conventional fashion on ball bearings 22 in a journal 20. The roll body 10 of the disintegrator roll 1 possesses, where these ball bearings 22 are concerned, a clearance 23, so that its rotation is not impaired by the non-rotating journal 20.

The set of fittings 110 is in accord with the embodiment shown in FIG. 1, which also demonstrates the interpositioning of a ring 111, which encircles the outer circumferential surface of the fittings carrier 11. However, as may be seen in FIG. 1, it is entirely possible to place the fitting 110 directly on the outer circumferential surface of the fittings carrier 11. To assure the centering of the fittings carrier 11, the roll body 10 possesses a ring groove 100 facing the fittings carrier 11, into which the fittings carrier 11 with the fittings 110 carrying ring 111 partially penetrates.

The connection of the fittings carrier 11 to the roll body 10 is subjected to no great axial forces, since, during the spinning operation, essentially only radial forces act upon the individual components of the disintegrator roll 1. Consequently, a clip type connector 3 suffices, which, in accord with the embodiment shown in FIG. 1, is comprised of a stud 30 as well as a stud receptor 31. In this arrangement, the stud 30 (or a similar boltlike element) extends longitudinally in a radial direction toward the inside, that is, in the direction of the drive shaft 2 and is made as an integral part of a ring 300, which is placed in a corresponding recess 112 of the fittings carrier, which recess extends circumferentially within the entire circumference of the fittings carrier 11.

Figure 2:
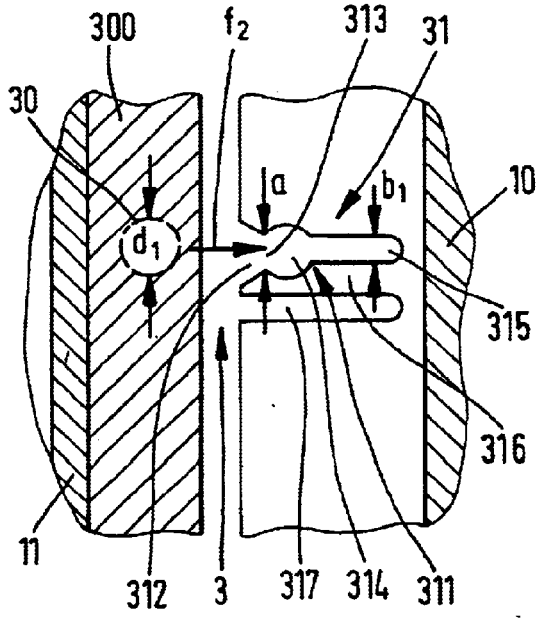
FIG. 2 in plan view, a detail of the connector shown in FIG. 1 (view I—I)

The roll body 10, also carries a ring 310 with the already mentioned stud receptor 31. This receptor 31 is essentially in the shape of a open slot 311, which, itself, is oriented essentially parallel to the disintegrator roll axis of drive shaft 2. The slot 311 possesses on its open end, which is facing the length of the stud 30, (which is to enter therein) a tapered entry 312, which terminates in a narrow passage 313 (see FIG. 2 as well). At this narrow passage 313, the sidewalls of the said slot 311 exhibit a side to side distance a which is smaller than the diameter $d_1$ of the stud 30. At this narrow passage 313, is an adjacent enlargement 314, which, in regard to shape and dimensioning, essentially fits the shape and the dimensioning of the stud 30. FIG. 2 shows the slot 311 continues on from this enlargement 314, in a longitudinal stretch 315 of width $b_1$ which is less than the diameter of the said enlargement 314.

As can be seen in FIG. 2, running essentially parallel to the slot 311 is provided an additional slot 317, which is so closely placed by the first slot 311, that the relatively thin side wall 316 can yield when the stud 30, passes through the said narrow passage 313 in its penetration movement. The wall 316, conversely, returns to its original, narrow position when the stud has continued on and rests in its place within the complementary, slot enlargement 314. To this end, the ring 310, in the embodiment according to FIG. 1, is made of a resilient material, for instance, from an appropriate plastic.

Various fibers are feed materials for open-end spinning machines, especially natural fibers such as cotton, but also artificial substances such as polyacryl, polyester, viscose and mixtures of any of these. These varied fiber materials are not uniformly disentangled in optimum manner with fittings 110 of universal application, even if the speed of rotation of the disintegrator is adjusted to the individual fiber material. What is looked for as necessary is the achievement of optimal spinning results. To bring about such results, it is desirable to apply the best suited fittings 110 with appropriate distribution of teeth or tooth-shape or to employ fittings of optimum needle type.

An exchange of the fittings 110 is introduced by bringing the disintegrator roll 1 to a standstill. Then, in a conventional way, the disintegrator roll 1 is made accessible, so that the fittings carrier 11 can then be seized, and in the direction of the arrow $f_1$ pulled away from the roll body 10. When the stud 30 leaves the stud receptor 31, the sidewall 316 yields from the pressure exerted by the stud 30, until the stud 30 has passed through the narrow passage 313. During the withdrawal of the stud 30 out of the stud receptor 31, the fittings carrier 11 along with the ring 111 and the fittings 110 simultaneously leave the ring groove 100 of the roll body 10. The fittings carrier 11, freed in this way from the roll body 10, can now be completely taken out of the housing of the disintegrator.

In a similar manner, subsequently an already prepared fittings carrier 11 with a different fitting 110 can be installed. After this has been properly positioned in respect to the roll body 10, then the fittings carrier 11, by means of an axially directed force can be connectingly pushed in the direction of the roll body 10. As this is done, the ring shaped area of the fittings carrier 11 carrying the fittings 110 is centered in the annular groove 100 of the roll body 10, while the stud 30 now enters the area of the tapered entry 312, whereby the stud receptor 31 sets up an increasing resistance until the stud 30 has passed the narrowed passage 313 and snaps into the slot enlargement 314. When the connection apparatus 3 once again takes up its holding position, then the position of the stud 30 is exactly defined in the stud receptor 31, since the stud 30 cannot leave the slot enlargement 314 either in the direction of the entry tapering 312 nor in the opposite direction of the longitudinal extension 315 which is too narrow for its passage.

If in such a case, as shown in the embodiment of FIG. 1, the connection device 3 is not installed coaxial to the drive shaft 2, the recommendation would be to provide two or more connection apparatuses 3 of that kind. These would be arrayed in a circle concentric to the drive shaft 2 at equal circumferential distances from one another (not shown). With such an apportionment, unbalance would be avoided.

The release of the connection apparatus 3 can be supported with the help of an ejection device 4, which, in accord with the embodiment shown in FIG. 1, possesses an ejection plate 40 which can be inserted to be against a provided, internal ejector contact surface 41 on an end wall 113 of the fittings carrier 11. This end wall 113 covers that side of the fittings carrier 11 adjacent to the end of the drive shaft 2. The ejector contact surface 41 is to be found on that side of the end wall 113 proximal to the roll body 10. For the sake of safety, in order to avoid a tilt of the fittings carrier 11 in relation to the roll body 10 during the withdrawal by the ejection plate 40, in accord with the embodiment of FIG. 1, the contact surface 41 is placed concentric to the fittings carrier 11.

The ejection contact surface 41 surrounds a ejection plate access opening 42 (FIGS. 1, 3) which penetrates the said end wall 113 of the fittings carrier 11. Both this ejection plate access opening 42 and also the ejection plate 40 possess, respectively, a contour which deviates from the circular, so that the ejection plate 40 can be brought into a first turning position through this ejection plate access opening 42 on the side of the end wall 113 remote from the roll body 10. In this way, the shape of the non-circular ejection plate access opening 42 and the ejection plate 40, may assume, for example, the shape of a triangle, or a rectangle, an oval, or the like.

Figure 3:
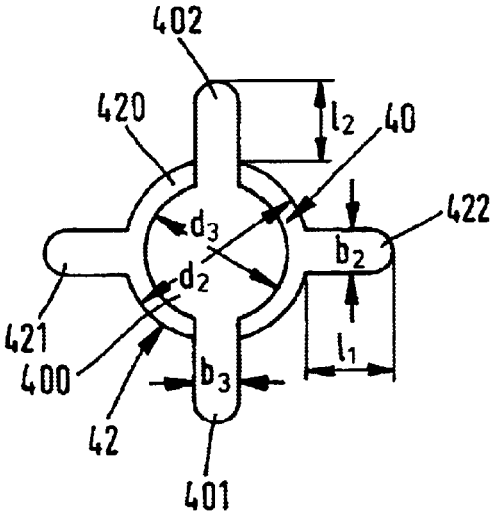
FIG. 3 in front view, a further detail of the apparatus shown in FIG. 1, (in direction of $f_2$)

In accord with the embodiment shown in FIG. 3, the ejection plate access opening 42 is comprised of a circular, open mid-area 420 as well as two diametrically opposite slots 421 and 422, the widths $b_2$ of which are smaller than the diameter $d_2$ of the central section 420. A similar contour is shown by the ejection plate 40, wherein the diameter $d_3$ of its center section 400 is smaller than the diameter $d_2$ of the center section 420 of the ejection plate access opening 42 and the length $l_2$ and the width $b_3$ of its radial projections 401 and 402 are less than the corresponding dimensions of the center area length $l_1$ and width $b_2$ of the slots 421 and 422.

If the ejection plate 40 has passed through the ejection plate access opening 42, then, the ejection device 4 would be brought by turning about its longitudinal axis into a second rotated position, in which, by withdrawing the ejection device 4 in the direction of the arrow $f_1$, the radial projections 401 and 402 on the ejection plate contact surface 41 lie between the slots 421 and 422 and upon a further pulling action in said direction, the stud 30 moves out of the stud receptor 31. In the same action, the ring 111 and the fittings 110 are released from the ring groove 100, so that the now loosened fittings carrier 11 can be withdrawn from the roll body 10.

The object of the invention, within the framework of the invention, can be altered in many ways, especially by means of the exchange of individual or several features with equivalents, or by other combinations of the invented features or their equivalents. Instead of the described arrangement, also a reversed placement of the stud 30 and the stud receptor 31 is possible, so that the stud 30 is carried by the roll body 10 and the stud receptor 31 is a component of the fittings carrier 11.

It is further possible, that the stud 30 be aligned parallel to the axis of rotation of the drive shaft, whereby the stud 30 would be provided with a thickened head (not shown). Also, in such a design and orientation of the stud 30 (also not shown), the stud 30 can be introduced, again with its thickened head, into the tapered entry 312 and through the narrow passage 313 to come to rest in the widened opening 314. In this case the bolt also carries out its function for the establishment of the connection between the roll body 10 and the fittings carrier 11. The release of this lockup is done in an analogous manner as this has been explained in connection with a bolt 30 which has been installed in the radial direction.

The stud receptor 31, instead of being in the form of a slot 311, can also be a boring, which possesses laterally situated elastic elements for the snap in of the stud 30 as it assumes its operational position.

It is obvious that the stud 30 need not be carried by a ring 300 which is part of the fittings carrier 11, but can be placed directly in a corresponding boring (not shown) of the fittings carrier 11 or the roll body 10 (in an reverse design of the connection apparatus 3).

Instead of an elastic design of the sidewall 316, an alternative provision could be, that the side wall 316 be made of a rigid material and parts of this sidewall 316 (for example, at the area of the narrow passage 313) be subjected to the loading of an elastic element, for example a compression spring or the like, in order to make possible the required yielding motion. Alternatively, provision can be made that the stud receptor 31 be made wholly rigid, and accordingly, the stud 30 would then possess the elastic characteristics. In this case, the stud, for example, on its free end or head area, would carry an elastic ring or the like (not shown). This elastic ring, during its introduction into the tapered entry 312, would be pressed into a circumferential groove in the stud 30, until this elastic element, upon reaching the expansion 314 could once again expand and hold the stud 30 in its desired position.

Figure 4:
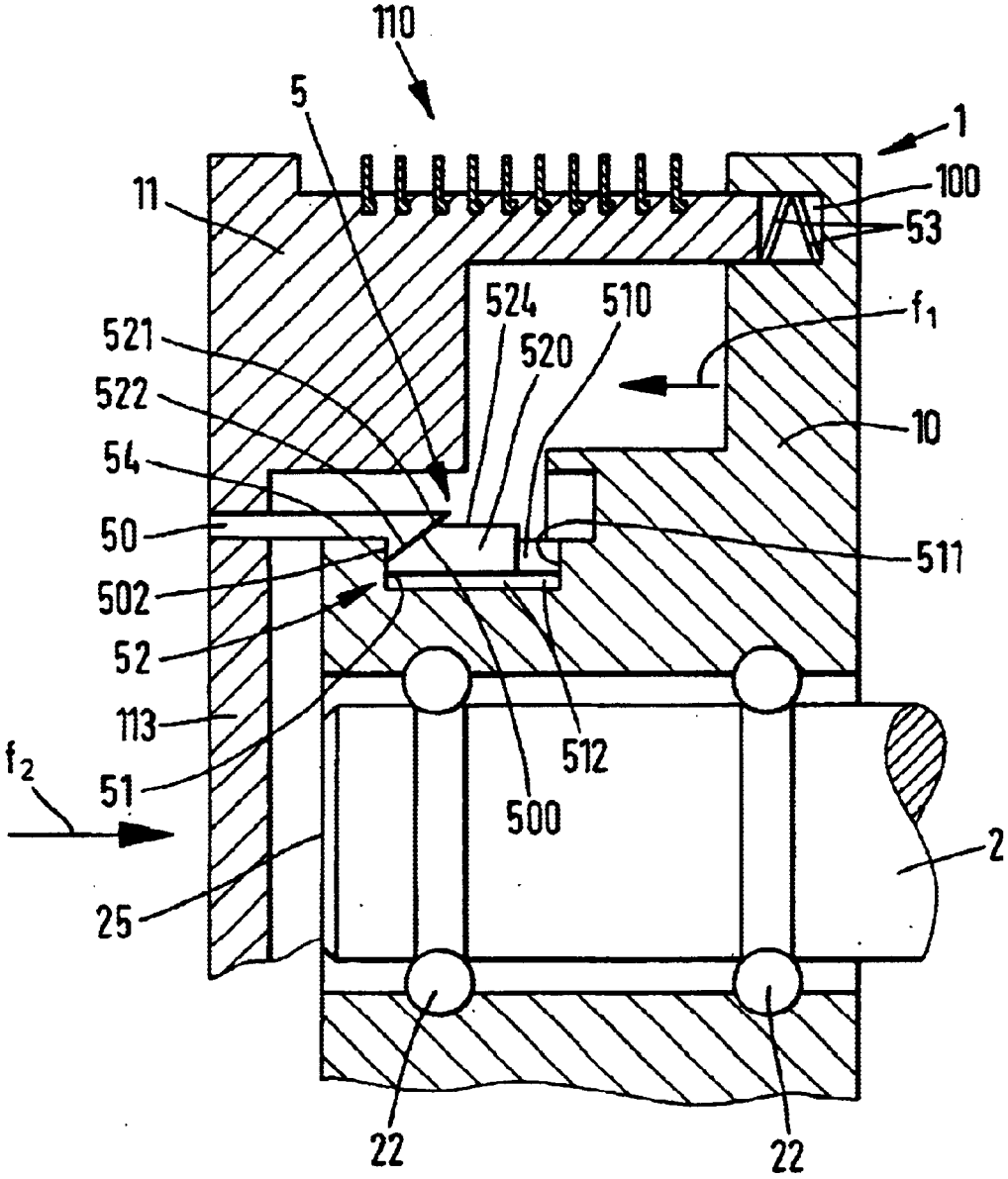
FIG. 4 a section of an invented latch type connector between the roll body and the fittings carrier of the disintegrator.

Instead of a clip type connection device 3, a latch type connection apparatus 5 could be employed (FIG. 4). This possesses, essentially, a latching member hook 50 as well as a latch shoulder 51 and a release apparatus 52. Principally, no difference is made, in this case, as to whether the latch S0 is mounted on the fittings carrier 11 and the recess 510 with the latch shoulder 51 is carried by the roll body 10 or whether the arrangement of these components is reversed. However, from the design standpoint, it is to be recommended as advantageous to place the release apparatus 52 in that same place where the latch shoulder 51 is located.

In accord with FIG. 4, the latch hook 50 is firmly bound to the fittings carrier 11 and extends itself parallel to the axis of the drive shaft 2 in the direction of the roll body 10. This roll body 10 possesses a recess 510, which extends in the longitudinal direction of the latch hook 50 on a guide surface 54, which recess 510 is bordered on its end proximal to the fittings carrier 11 by a latch shoulder 51. The end of the said recess 510, remote from the said latch shoulder 51, is terminated by a detent 511.

The release apparatus 52 possesses, as an essential component, a sliding element 520, which can move back and forth between the detent formed by the said latch shoulder 51 and the detent 511. In this action, the sliding element 520, by an appropriate, guide (which is only schematically indicated) is secured in the recess 510.

In the connection position shown in FIG. 4, the latch hook 50 is locked behind the latch shoulder 51 and is thus held in this position. In this case, an elastic construction of the latch hook 50 will suffice for this function. In order to increase the assurance of the retention power of said latch hook 50, the fittings carrier 11 is loaded by a an elastic element, for example, two leaf springs 53, in a direction toward the latch shoulder 51 so that the latch hook 50 is pressed against the latch shoulder 51. This elastic element in the form of leaf springs 53 is placed independently of the connection apparatus 5, whereby for this function, the said annular groove 100 of the roll body 10 suffices.

In order to activate the release mechanism 52 for the lifting of the connection between the roll body 10 and the fittings carrier 11, so that this is freed, the latch hook 50 is moved counter to the force of the leaf springs 53 in the longitudinal direction of the recess 510. To this end, a pressure in the direction of the arrow $f_2$ is exerted against the fittings carrier 11. When this is done, the latch hook 50 pushes the release element 520 before it until the release element reaches the detent 511 on the other end of the recess 510. At this moment, the latch hook 50 slides over a lifting edge 521, which is part of the release element 520, reaching a guide surface 524 which is also part of the release element 520, that element now being motionless, due to its abutting the detent 511. Because of the ending of the exertion of pressure on the fittings carrier 11, the said leaf springs 53 force the fittings carrier 11 in the direction of the arrow $f_1$ and thereby away from the roll body 10. The latch hook 50 is carried along, without leaving the guide surface 524 of the release element 520, which element also follows this movement. Now the release element 520 finally abuts the latch shoulder 51 and is thereby prevented from following the progressing return movement of the fittings carrier 11. Because of the abutment of the release element 520 against the said latch shoulder 51, the latch hook 50 can not engage anew on the latch shoulder 51, but slides off the guide surface 524 of the release element 520 and onto the unobstructed surface 54. The fittings carrier 11 can now be removed from the roll body 10.

As may be seen from the above description, due to being lifted out of the recess 510, the latch hook 50 comes into a movement track which circles the recess 510, in which the latch hook 50 is conducted around the recess 510. When this occurs, this movement path is formed essentially by means of the guide surface 524 of the release element 520 as well as the guide surface 54.

Another fittings carrier 11, equipped with such fittings as is desired, now can be installed in place of the removed fittings carrier 11 by being pushed onto the roll body 10 in the direction of the arrow $f_2$. In this way, the latch hook 50 reaches the release element 520 and pushes this before it, until the latch hook 50 engages itself behind the latch shoulder 51 and thus secures the fittings carrier 11 in its position against the roll body 10.

In order to assure the security of the sliding, i.e., the come-along of the release element 520 in the desired manner, provision can be made, that the release element 520 slightly exceeds the height the recess 510. In order to ease the pushing of the latch hook 50 on to the release element 520, the latch hook 50 can have a run-on ramp on its end proximal to the release element 520, which enables the elastically designed or elastically held latch hook 50 to yield in such a manner, that it can slide onto the release element 520. For this purpose, the lifting edge 521 proximal to the latch hook 50 can be provided, outside of the recess 510, with a chamfer or a small ramp 522.

In an embodiment, not presented in a figure, in the case of the just described embodiment the release element 520 can be furnished without, or only with a short run-on ramp, and, on this account, the lifting edge 521, upon contact of the release element 520 against the latch hook 51, stands slightly above the latching shoulder 51. Thereby, the latch hook 50 springs over the latch shoulder 51 upon the withdrawal of the latch hook 50.

Figure 5:
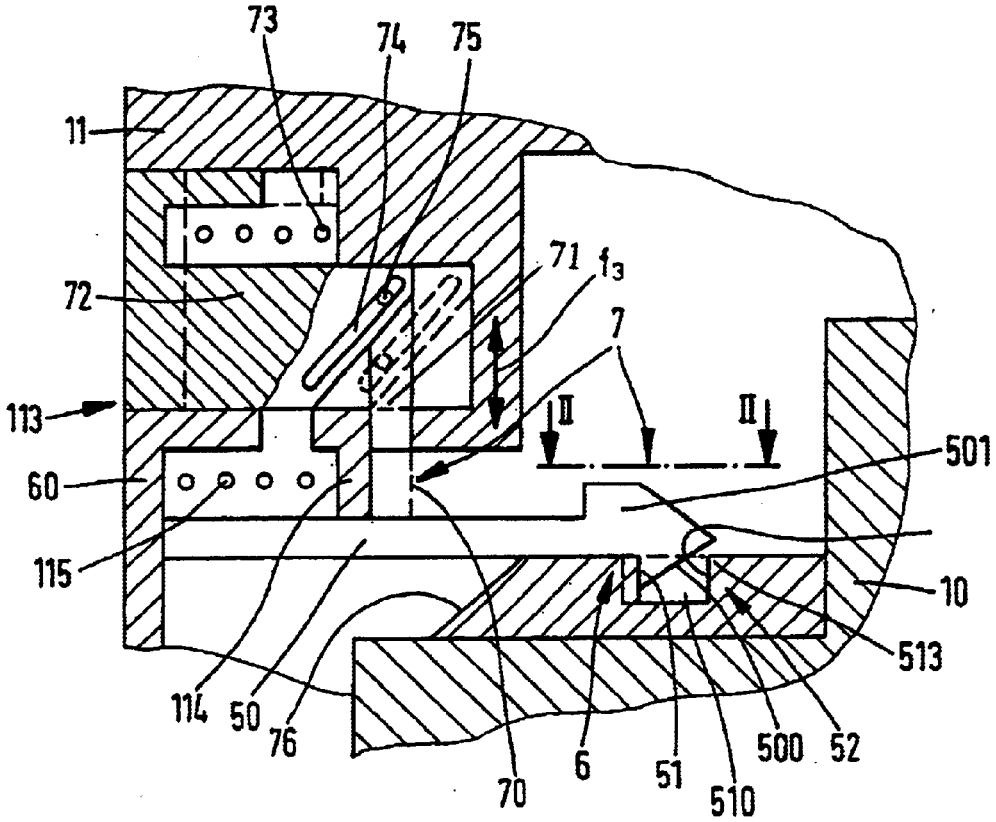
FIG. 5 a section of another design of a latch type connector.
Figure 6:
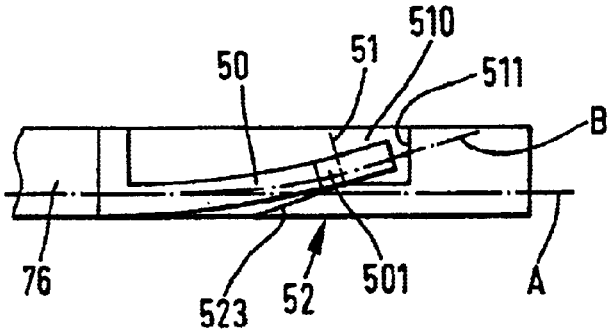
FIG. 6 a plan view on the latch type connector of FIG. 5 (section II—II)

In accord with the variant shown in FIGS. 5, 6, the release apparatus 52 possesses a displacement means designed as an angled diversion 523, which deflects the latch hook 50 to the side. Upon pushing the fittings carrier 11 onto the roll body 10, the elastically constructed, or the elastically secured latch hook 50 is diverted hereby from the straight movement path A into a deflected curved path B, in which the recess 510 is to be found, and where the latch hook 50 engages itself behind the latch shoulder.

For the lifting of this latch connection, the latch hook 50 with its ramp 500 is caused to run on to a lift edge 513 on the other end of the recess 510, and thereby, is completely lifted out of the recess 510 and out of the operational area of the diversion means 523 so that the sideways bending of the prestressed latch hook 50 reassumes its straight position once more and thus returns directly into the straight movement track A, which runs next to the curved track B. If now, the fittings carrier 11 is withdrawn from the roll body 10, then, the latch hook 50 does not create any resistance to said withdrawal, because the latch hook 50 is no longer in the diverted path B of movement with the latch shoulder 51.

In accord with FIG. 5, the latch hook 50 is connected to a supporting surface 60, which is movably placed in the fittings carrier 11. The support surface 60 is held relatively large and serves as an operative element for the connection apparatus 6. If several connection apparatuses 6 are placed equally apportioned about a circular line in the front wall 113 of the fittings carrier 11, then the support surface 60 can also be ring shaped and be designed as a common operative element for a plurality of connection apparatuses 6. The radial support surface 60 is loaded toward the latch shoulder 51 by a compression spring 115, the other end of which abuts against a radial support wall 114 of the fittings carrier 11. For the lifting of the latch connection between the fittings carrier 11 and the roll body 10, the fittings carrier 11 must not be in motion, but a movement of the latch hook 50 suffices, which is attained by pressure on the support surface 60.

For the securement of the connection apparatus 6 in the fittings carrier 11, a restraint 7 is provided, as a part of which, the latch hook 50 (see FIG. 5) possesses a second hook, which coacts with one of the independent safety detents 70 of the connection apparatus 6. If the latch hook 50, as a result of its release, leaves the area of the connection apparatus 6, then it proceeds with its second hook 501 to contact this security detent 70 and would be held back in this position. The securement detent 70 is a part of the slider 71 which is movable transversely to the direction of motion of the latch hook 50 (see double arrow $f_3$) and is operated by means of an activation device 72, which in turn is loaded by a compression spring 73 and by means of a (not shown) detent—or the like—is prevented from being pushed outward over the surface of the end wall 113.

The activation apparatus 72 possesses a guide plate 74, with which a bolt 75 carried by a slider 71 engages. The slider 71 is conducted in a radial direction with the aid of a guide (not shown), so that it can principally carry out radial movements. In the position shown in FIG. 5 by dotted lines the slider 71 is found in its operational position, in which the latch hook 50, after its release by the connection apparatus 6 comes into contact with the latch shoulder 70. If now the activation apparatus 72 is activated, then the slider 71, with the aid of the plate guide 74 is drawn out of the space of the latch hook 50, which is hereby released. Accordingly, provision may be made, that the connection apparatus 6, in the connection on the guide surface 54 which is proximal to the fittings carrier 11, can exhibit an incline 76, so that the space between the support wall 114 and the roll body 10 is increased. If the hook 501, after the withdrawal of the slider 71, comes to lie adjacent with the support wall 114, then, by an appropriate energizing of the activation element 72 the slider is pushed against the hook 501, in order to slide this downward from the support wall 114, so that the latch hook 50, while making use of the space created by the incline 76, releases the fittings carrier 11.

Figure 7:
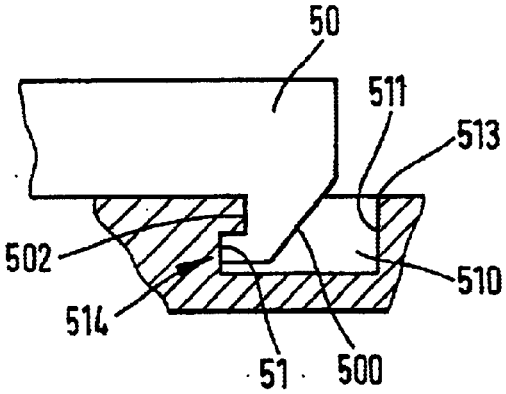
FIG. 7 a sectional detail of the connector shown in FIG. 5 in a variant design.

At the operational speed of rotation of the disintegrator roll 1 of 8000 or more RPM, severe centrifugal forces are present. In order to secure the latch hook 50 in its idle position against these centrifugal forces, the latch shoulder 51 can be designed with a back-cut 514 and the latch hook 50 which engages with latch shoulder 51, can be provided with a recess 502 which is complementary to the back-cut 514 (see FIG. 7). If the latch hook 50 is directly, or indirectly loaded with the force of the leaf springs 53 or the like (see FIG. 4) or of a compression spring 115 (see FIG. 5), then the latch hook 50 is pressed even more securely into the backcut 514, so that the latch hook 50 cannot undesirably leave the back-cut 514. According to the arrangement of the latch shoulder, the back-cut 514 can be in an acute angle, relative to the guide surface 54, or made to fit a stepped form of the latch shoulder 51.

Instead of a lifting edge 521 or 513, a lifting means can be activated by the motion of the latch hook 50 and can be provided (not shown). This would be, for instance, a kind of an angular lever, which is pivoted by means of the advance of the latch hook 50 and thereby, the latch hook 50 is lifted out of the recess 510.

Figure 8:
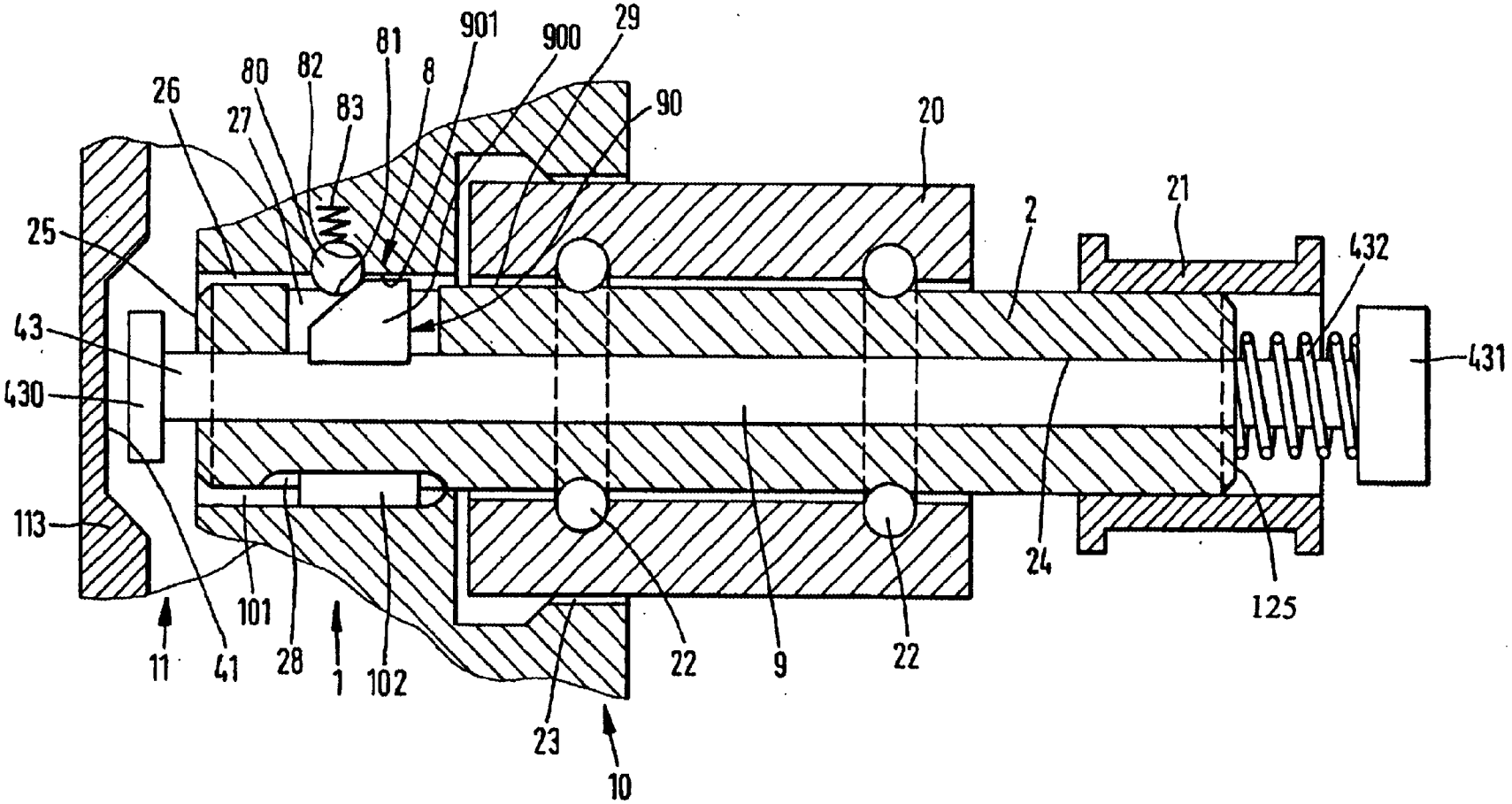
FIG. 8 in a schematic cross-section, an invented connector between the drive shaft and the roll body of the disintegrator roll, including an activation element for this connection apparatus.

FIG. 8 shows an activator element 9 serving now as an ejection device 43 which is located in the drive shaft 2, which is designed as a hollow shaft. The activator element 9 is pushed inside the drive shaft 2 in the longitudinal direction and abuts the contact surface 41, so that the withdrawal of the fittings carrier 11 from the roll body 10 is supported.

In case it is desired, and if space conditions allow, it is entirely possible that this ejector 43 can be inserted each time upon need, in the drive shaft 2 from its end distal from the disintegrator roll 1 or, in the reverse action, be once again withdrawn from the drive shaft 2. It would be more simple to manipulate and, in consideration of the generally very close space conditions, also more advantageous, if this ejector 43 were to remain permanently in the drive shaft 2 of the disintegrator roll 1. In this way, the connection apparatus 3, 5 or 6 without the aid of tools, can be brought not only into its connection position but also into its release position.

In order to prevent the ejector 43 from undesirably leaving the drive shaft 2, that end of the ejector 43 which is proximal to the end wall 113 of the fittings carrier 11 is equipped with a striking plate 430, which extends itself in a radial direction beyond the boring 24 which accepts push-out device 43 in the drive shaft 2. In an analogous manner, also that end of the ejector 43 which is remote from the fittings carrier 11 is equipped with a manual push-plate 431. In this way, the maximum thrust path of the ejector 43, relative to the drive shaft, is a specified distance. So that the contact plate 430 does not undesirably come to rest on the face of the end wall 113 of the fittings carrier 11, in accord with the depicted embodiment, between the plate 431 and the end 125, which is proximal to this plate 431, a compression spring 432 is installed, or another analogous elastic element is provided, which, for instance, holds the ejector 43 always in that end position, in which its contact plate 430 maintains a specified distance from the provided ejector contacting surface 41 which is on the front wall 113 of the fittings carrier 11, or from a releasing position of the connection apparatuses 3, 5 or 6. To initiate the removal of the fittings carrier 11 from the roll body 10, the assigned operator presses the ejector 43 counter to the force of the compression spring 432 against ejection surface 41. After its release, the ejector 43 returns into its operative base position again because of the force of the compression spring 432.

For example, arrangements can be made to clean the covered, inner face surface of the housing (not shown) of the disintegrator roll 1 and to remove the disintegrator roll 1 in its entirety from the drive shaft 2. So that the drive shaft 2 can remain in the machine, between the roll body 10 and the drive shaft 2 is provided a clearance 26 and for the connection of the roll body 10 with the drive shaft 2 a clip type 3 or a latch arrangement 8 is available. This is principally to fulfill the purpose of assuring that the roll body 10 remains in axial alignment on the drive shaft 2. However, the components can also take on responsibility for the transmission of the rotation from the drive shaft 2 to the roll body 10.

The clip or latch type connection apparatus can be constructed in various manners. The following description limits itself to an embodiment example of the type shown in FIG. 8, in accord with which, for the transmission of the rotation from the drive shaft 2 to the roll body 10, a latch type connection is provided. This has at least one sphere 80, which is retained for one part, in a complementary recess 81 in the circumferential surface of the drive shaft 2 and for the other part, fits into a corresponding recess 82 in the inner circumferential surface of the roll body 10. The sphere 80 is, in this installation, subjected to the force of a compression spring 83 by means of which the sphere 80 is pressed into the said recess 81.

In order to be able to withdraw the roll body 10 from the drive shaft 2, principally, no additional measures or auxiliary means are required. However, the removal of the roll body 10 from the drive shaft 2 is eased, and also a later reverse action of replacing the roll body 10 on the drive shaft 11 are additionally eased by the already cited activation element 9. In accord with the embodiment shown in FIG. 8, the ejector 43 is an integral component of this activation element 9, however, the activation element 9 can be provided for the activation of the connection apparatus 8 independent as to whether an ejector 43 is provided or not. The activation element 9 is integral with a lifting device 90 acting in a radial direction, which, in the embodiment shown in FIG. 8, is constructed in the form of one or more cams 900, which extend themselves in a radial direction and reach, essentially, to an imaginary extended outside surface line 29 of the drive shaft 2. The depicted, at-least-one cam 900, is guided into a slot shaped radial opening 27 of the drive shaft 2. This slot 27 ends in the recess 81. The slot 27 has such a length, in the direction of the activation element 9 in the axial boring 24 of the drive shaft 2, that the cam 900 (or a plurality thereof, in which case a sphere 80 for each must be provided)—if the sphere 80 is to enter its recess 81—is withdrawn from that area of said recess 81. The cam 900 is now available for the lifting of the connection between the drive shaft 2 and the roll body 10 of the connection apparatus 8. Accordingly, the cam 900 moves into the connection apparatus 8 in such a manner, that the sphere 80 is lifted up the cam ramp onto a surface 901 of the cam 900. This surface is at the level of the circumferential surface of the drive shaft 2. In this position of the sphere 80, the axial movement of the roll body 10 is free of obstruction.

Instead of the sphere 80 and the recess 81, it is also possible, for a corresponding result, to provide (not shown) a centering and locking rod moving in a radial direction with a centering boring. In an additional embodiment, the sphere 80 or the said centering rod can be provided on the drive shaft 2 and the recess 81 or the centering hole on the roll body. Because of centrifugal force, the pressure of the sphere or the centering rod on the, recess or centering opening is greatly increased, which leads, during rotation, to a much stronger connection and centering effect. A corresponding connection can also be established between the roll body 10 and the fittings carrier 11.

The described sphere(s) 80 of the connection apparatus, as already mentioned, suffices for the rotational inclusion effect of the roll body 10 by the drive shaft 2. In order that the rotational inclusion effect can be achieved independently of the connection apparatus 8, in accord with FIG. 8, for example, both in the circumferential surface of the drive shaft, as well as that of the roll body 10, a longitudinal groove 28, or a groove 101 is provided, in which a spring 102 is inserted. The force fit connection between the drive shaft 2 and the roll body 10 in the direction of rotation can also be effected by a kind of toothed engagement, or yet in another manner.

What is claimed is:

1. A disintegrator roll for use in a textile spinning machine, comprising:

a roll body releasably mounted on a drive shaft;

a fittings carrier with associated fittings releasably mounted on said roll body;

a releasable connection apparatus operably disposed between at least one of said fittings carrier and said roll body or said roll body and said drive shaft; and wherein said connection apparatus is actuated by an axial force applied generally parallel to said drive shaft; and said connection apparatus operably disposed between said fittings carrier and said roll body and comprises a stud provided on one of said roll body or said fittings carrier, and a receptor provided on the other of said fittings carrier or said roll body, said receptor having an open end and a narrowed passage configured for sliding receipt of said stud, at least one of said stud or said receptor being elastically deformable.

2. A disintegrator roll for use in a textile spinning machine, comprising:

a roll body releasably mounted on a drive shaft;

a fittings carrier with associated fittings releasably mounted on said roll body;

a releasable connection apparatus operably disposed between at least one of said fittings carrier and said roll body or said roll body and said drive shaft; and wherein said connection apparatus is actuated by an axial force applied generally parallel to said drive shaft; and said connection apparatus including a latch hook that releasably engages with a latch shoulder, and further comprising a release apparatus configured with said latch hook, said release apparatus actuated by movement of said latch hook in an axial direction.

3. The disintegrator roll as in claim 2, wherein said latch shoulder is defined by a recess in which said latch hook resides in a latched state of said connection apparatus, said release apparatus further comprising a lifting edge onto which said latch hook runs upon axial movement of said latch hook, said lifting edge diverting said latch hook out of said recess and out of engagement with said latch shoulder.

4. The disintegrator roll as in claim 3, wherein said lifting edge is defined on a component axially moveable within said recess between opposite detent positions, and further comprising a guide surface defined by said moveable component upon which said latch hook rests upon being diverted out of said recess and out of engagement with said latch shoulder at a first of said detent position, said moveable component returnable to said opposite detent position upon said latch hook resting on said guide surface.

5. The disintegrator roll as in claim 4, wherein said release apparatus further comprises a diversion member disposed to divert said latch hook into said recess upon pushing said latch hook axially into engagement with said latch shoulder.

6. The disintegrator roll as in claim 3, wherein said latch shoulder further comprises a back-cut, said latch hook comprising an indent shaped to engage with said back-cut.

7. The disintegrator roll as in claim 2, wherein said latch hook is configured on said fittings carrier and said latch shoulder is configured in said roll body.

8. The disintegrator roll as in claim 7, wherein said fittings carrier comprises a safety detent, and said latch hook comprises a safety restrain hook engageable in said safety detent.

9. A disintegrator roll for use in a textile spinning machine, comprising:

a roll body releasably mounted on a drive shaft;

a fittings carrier with associated fittings releasably mounted on said roll body;

a releasable connection apparatus operably disposed between at least one of said fittings carrier and said roll body or said roll body and said drive shaft; and wherein said connection apparatus is actuated by an axial force applied generally parallel to said drive shaft; and said connection apparatus operably disposed between said fittings carrier and said roll body, and further comprising an ejector device disposed at least partially through said fittings carrier, said ejector device comprising an ejector plate coacting with an ejector contact surface defined on said fittings carrier.

10. The disintegrator roll as in claim 9, wherein said ejector contact surface is coaxial with a rotational axis of said roll body.

11. A disintegrator roll for use in a textile spinning machine, comprising:

a roll body releasably mounted on a drive shaft;

a fittings carrier with associated fittings releasably mounted on said roll body;

a releasable connection apparatus operably disposed between at least one of said fittings carrier and said roll body or said roll body and said drive shaft; and wherein said connection apparatus is actuated by an axial force applied generally parallel to said drive shaft; and said drive shaft includes a generally hollow shaft section, and further comprising an ejector device operably disposed between said drive shaft and said fittings carrier, said ejector device comprising an activator element disposed longitudinally within said hollow shaft section that is engageable against an ejector contact surface defined on said fittings carrier, said ejector contact surface coaxial with a rotational axis of said roll body.

12. A disintegrator roll for use in a textile spinning machine, comprising:

a roll body releasably mounted on a drive shaft;

a fittings carrier with associated fittings releasably mounted on said roll body;

a releasable connection apparatus operably disposed between at least one of said fittings carrier and said roll body or said roll body and said drive shaft; and wherein said connection apparatus is actuated by an axial force applied generally parallel to said drive shaft; and said roll body is mounted to said drive shaft with said connection apparatus, and further comprising a radial clearance between said roll body and said drive shaft, said connection apparatus rotationally coupling said roll body to drive shaft such that said roll body is rotated with said drive shaft and is removable from said drive shaft by being axially pulled from said drive shaft.

13. The disintegrator roll as in claim 12, wherein said drive shaft comprises a generally hollow shaft section, and further comprising an ejector device operably disposed between said drive shaft and said fittings carrier, said ejector device comprising an activator element disposed longitudinally within said hollow shaft section that is engageable against an ejector contact surface defined on said fittings carrier, said ejector contact surface coaxial with a rotational axis of said roll body.

14. The disintegrator roll as in claim 13, wherein said activator element comprises a lifting device acting in a radial direction to release said connection device upon axial movement of said activator element.

15. The disintegrator roll as in claim 14, wherein said activator element is non-removable from said shaft.

16. The disintegrator roll as in claim 14, wherein said activator element is spring biased.

* * * * *